US008837995B2

(12) United States Patent
Ohashi

(10) Patent No.: US 8,837,995 B2
(45) Date of Patent: Sep. 16, 2014

(54) IMAGE APPARATUS WITH COLOR REGISTRATION ADJUSTMENT, CONTROL METHOD THEREFOR, AND STORAGE MEDIUM STORING CONTROL PROGRAM THEREFOR

(75) Inventor: Yohei Ohashi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 154 days.

(21) Appl. No.: 13/528,946

(22) Filed: Jun. 21, 2012

(65) Prior Publication Data

US 2012/0328310 A1 Dec. 27, 2012

(30) Foreign Application Priority Data

Jun. 24, 2011 (JP) ..... 2011-140672

(51) Int. Cl.
*G03G 15/01* (2006.01)
*G03G 15/00* (2006.01)
*G03G 15/16* (2006.01)

(52) U.S. Cl.
CPC .... *G03G 15/0131* (2013.01); *G03G 2215/0158* (2013.01); *G03G 15/5058* (2013.01); *G03G 15/161* (2013.01)
USPC ..... 399/301; 399/44

(58) Field of Classification Search
CPC ..... G03G 2215/0158; G03G 2215/0161
USPC ..... 399/301, 44; 347/116
See application file for complete search history.

(56) References Cited

U.S. PATENT DOCUMENTS

| | | | | |
|---|---|---|---|---|
| 2006/0029407 | A1* | 2/2006 | Sakamoto | 399/44 |
| 2007/0297820 | A1* | 12/2007 | Shirakata | 399/44 |
| 2008/0279599 | A1 | 11/2008 | Nagatsuka | |
| 2011/0128599 | A1* | 6/2011 | Watanabe | |

* cited by examiner

*Primary Examiner* — Susan Lee
(74) *Attorney, Agent, or Firm* — Rossi, Kimms, McDowell LLP

(57) ABSTRACT

An image forming apparatus comprising image forming units, an image bearing member for bearing images, a table indicative of a correspondence relationship between temperature and an amount of a color misregistration. A pattern detection unit detects color registration patterns on the image bearing member. A calculation unit calculates the amount of the color misregistration based on the detection result of the patterns. A color registration adjustment unit has a first mode in which color registration adjustment is performed based on the amount of the color misregistration, and a second mode in which the amount of the color misregistration is predicted based on temperature using the table and the color registration adjustment is performed based on the predicted amount. An updating unit makes the image forming units form the color registration patterns when the temperature reaches a predetermined temperature, and updates the table based on the amount of the color misregistration.

6 Claims, 7 Drawing Sheets

FIG.3A

| | AMOUNT OF COLOR MISREGISTRATION [μm] | | |
|---|---|---|---|
| T[°C] | Δy | Δm | Δc |
| · | · | · | · |
| · | · | · | · |
| · | · | · | · |
| 23 | 10 | 12 | 16 |
| 25 | 15 | 17 | 21 |
| 27 | 20 | 22 | 26 |
| 29 | 25 | 27 | 31 |
| 31 | 30 | 32 | 36 |
| 33 | 35 | 37 | 41 |
| · | · | · | · |
| · | · | · | · |
| · | · | · | · |
| 45 | 100 | 102 | 106 |

FIG.3B

| | AMOUNT OF COLOR MISREGISTRATION [μm] | | |
|---|---|---|---|
| T[°C] | Δy | Δm | Δc |
| · | · | · | · |
| · | · | · | · |
| · | · | · | · |
| 23 | 10 | 12 | 16 |
| 25 | 15 | 17 | 21 |
| 27 | 20 | 22 | 26 |
| 27 | 22 | 24 | 28 |
| 29 | 25 | 27 | 31 |
| 31 | 30 | 32 | 36 |
| 33 | 35 | 37 | 41 |
| · | · | · | · |
| · | · | · | · |
| · | · | · | · |
| 45 | 100 | 102 | 106 |

IMAGE APPARATUS WITH COLOR REGISTRATION ADJUSTMENT, CONTROL METHOD THEREFOR, AND STORAGE MEDIUM STORING CONTROL PROGRAM THEREFOR

BACKGROUND OF THE INVENTION

1. Field of the Invention

The present invention relates to technique of a color registration adjustment.

2. Description of the Related Art

There is a color image forming apparatus of an electrophotography system having image formation units that sequentially transfer images in different colors onto a transfer belt. A problem of the apparatus is that a temperature change inside the apparatus causes color misregistration because positions of overlapped images of the respective colors are not matched with each other due to distortions and deformations of lenses and mirrors.

In order to solve the above-mentioned problem, there is a known color registration adjustment that forms color registration patterns on a transfer belt at predetermined timing, detects amount of the color misregistration by reading the color registration patterns using a sensor, and controls image-writing-start timing etc. according to the detected amount of the color misregistration.

However, since the above-mentioned color registration adjustment needs to form the color registration patterns at suitable time intervals or for every predetermined number of printed sheets, down time increases. Against this problem, there is a suggestion that adjusts color registration without using a color registration pattern by holding correlation between internal temperature and an amount of color misregistration beforehand, and by predicting the amount of the color misregistration from the internal temperature. For example, United States Patent Application Publication 2008/0279599 discloses a technique that improves accuracy of the color registration adjustment without forming a color registration pattern by storing the amount of the color misregistration and the internal temperature that are detected by using the color registration pattern into a table in order to learn the color misregistration characteristic inherent in a color image forming apparatus.

The image forming apparatus disclosed in the above-mentioned publication holds the internal temperature when a generating condition of the color misregistration is satisfied and the corresponding amount of the color misregistration as a table.

However, since the generating condition of the color misregistration is generally satisfied when continuous operation time or the number of continuous printed sheets exceeds a predetermined value, the information on the table tends to incline toward the data in high internal temperatures. Such inclined data does not correctly reflect the color misregistration characteristic of the color image forming apparatus. There is a possibility to deteriorate the accuracy of the color registration adjustment at the internal temperatures with little information stored in the table.

SUMMARY OF THE INVENTION

Accordingly, a first aspect of the present invention provides an image forming apparatus comprising a plurality of image forming units, an image bearing member configured to bear images formed by the image forming units, a table indicative of a correspondence relationship between temperature and an amount of a color misregistration, a pattern detection unit configured to detect color registration patterns on the image bearing member, a calculation unit configured to calculate the amount of the color misregistration based on the detection result of the color registration patterns by the pattern detection unit, a temperature detection unit configured to detect temperature, a color registration adjustment unit configured to have a first mode in which color registration adjustment is performed based on the amount of the color misregistration calculated by the calculation unit, and a second mode in which the amount of the color misregistration is predicted based on the temperature detected by the temperature detection unit using the table and color registration adjustment is performed based on the predicted amount of the color misregistration, and an updating unit configured to make the image forming units form the color registration patterns when the temperature detected by the temperature detection unit reaches a predetermined temperature, and to update the table based on the amount of the color misregistration calculated by the calculation unit based on the detection result of the color registration patterns by the pattern detection unit.

Accordingly, a second aspect of the present invention provides a control method for an image forming apparatus that is provided with a plurality of image forming units, an image bearing member for bearing images formed by the image forming units, and a table indicative of a correspondence relationship between temperature and an amount of a color misregistration, the control method comprising a pattern detection step of detecting color registration patterns on the image bearing member, a calculation step of calculating the amount of the color misregistration based on the detection result of the color registration patterns in the pattern detection step, a temperature detection step of detecting temperature, a first color registration adjustment step of performing a color registration adjustment based on the amount of the color misregistration calculated in the calculation step, a second color registration adjustment step of predicting an amount of the color misregistration based on the temperature detected in the temperature detection step using the table, and of performing a color registration adjustment based on the predicted amount of the color misregistration, and an updating step of making the image forming units form the color registration patterns when the temperature detected in the temperature detection step reaches a predetermined temperature, and of updating the table based on the amount of the color misregistration calculated in the calculation step based on the detection result of the color registration patterns in the pattern detection step.

Accordingly, a third aspect of the present invention provides a non-transitory computer-readable storage medium storing a control program causing a computer to execute the control method of the second aspect.

Further features of the present invention will become apparent from the following description of exemplary embodiments with reference to the attached drawings.

BRIEF DESCRIPTION OF THE DRAWINGS

FIG. 3A is a view showing an example of a color misregistration table stored in a memory in FIG. 2 as initial data.

FIG. 3B is a view showing an example of the color misregistration table in which color misregistration detected information is added to the initial data stored in the memory in FIG. 2.

DESCRIPTION OF THE EMBODIMENTS

Hereafter, embodiments according to the present invention will be described in detail with reference to the drawings.

Figure 1:
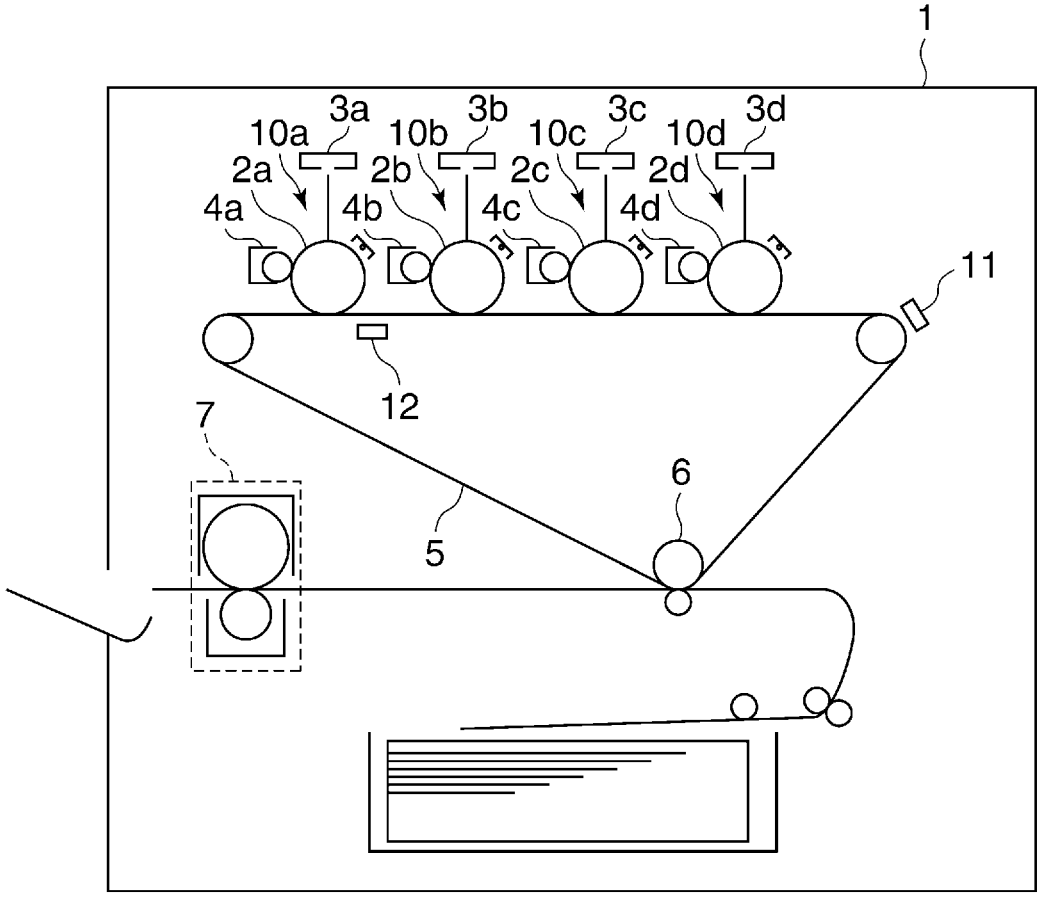
FIG. 1 is a view schematically showing a configuration of an image forming apparatus according to an embodiment of the present invention.

FIG. 1 is a view schematically showing a configuration of an image forming apparatus according to an embodiment of the present invention.

The image forming apparatus 1 is a color printer that has image forming units 10*a* through 10*d* for four colors including yellow (Y), magenta (M), cyan (C), and black (Bk), and forms a color image on a recording sheet based on image information. Each of the image forming units 10*a* through 10*d* for the respective colors is unitized.

The image forming apparatus 1 is provided with photosensitive drums 2*a* through 2*d* as image bearing members, laser scanning units 3*a* through 3*d* that include semiconductor lasers as light sources, development devices 4*a* through 4*d*, and a transfer belt 5 as an intermediate transfer body. The image forming apparatus 1 is provided with a secondary transfer roller 6, a heat fixing unit 7, a registration detection sensor 11 that detects the color registration patterns formed on the intermediate transfer body, and a temperature sensor (a temperature detection unit) 12 for detecting the internal temperature of the apparatus.

In the image forming apparatus 1, electrostatic latent images are formed on the photosensitive drums 2*a* through 2*d* for the respective colors by the laser scanning units 3*a* through 3*d*. The electrostatic latent images are developed by the respective development devices 4*a* through 4*d*. Toner images of the respective colors developed on the photosensitive drums 2*a* through 2*d* are primarily transferred to the transfer belt 5. The toner images of four colors on the transfer belt are transferred to a recording sheet by the secondary transfer roller 6, and are fixed to the recording sheet by the heat fixing unit 7 that consists of fixing rollers etc.

The laser scanning units 3*a* through 3*d* are provided with BD sensors (not shown), respectively, which generate BD signals as horizontal synchronizing signals by detecting passages of laser beams just before scanning the photosensitive drums 2*a* through 2*d*.

Figure 2:
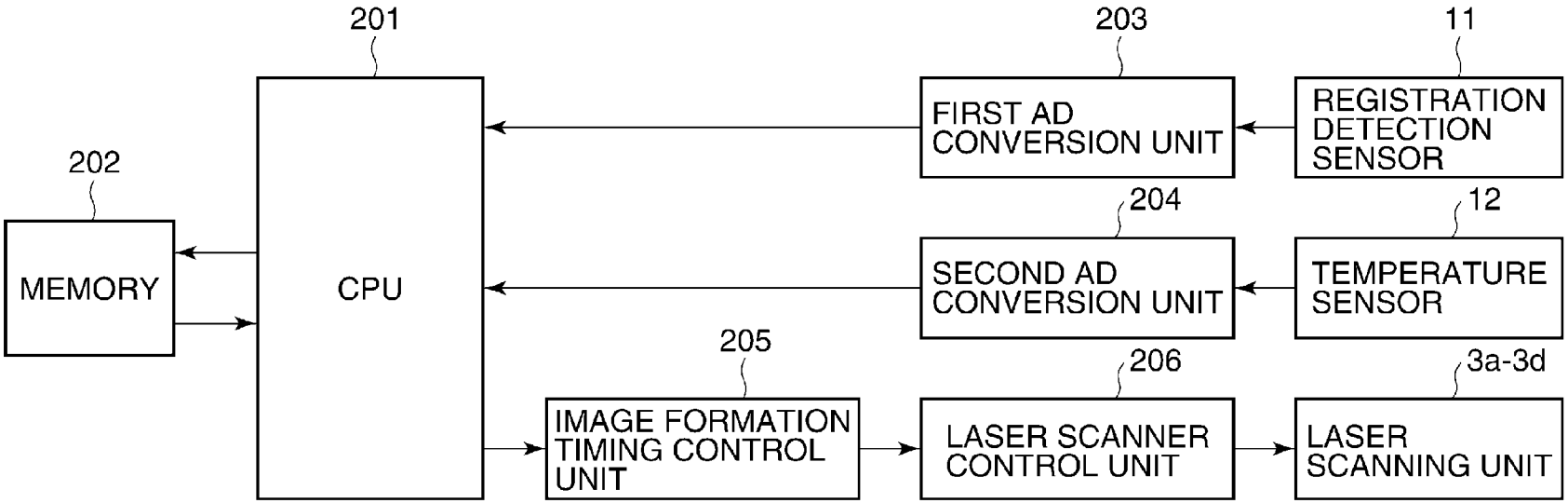
FIG. 2 is a block diagram schematically showing a configuration of a function part concerning a color registration adjustment operation in the image forming apparatus in FIG. 1.

FIG. 2 is a block diagram schematically showing a configuration of a function part concerning a color registration adjustment operation in the image forming apparatus 1 in FIG. 1.

A CPU 201 in FIG. 2 controls operations of the image forming apparatus 1. The CPU 201 calculates the amount of the color misregistration based on the output of the registration detection sensor 11, and also calculates an adjustment value for image formation timing. Moreover, the CPU 201 calculates a predicted value of the amount of the color misregistration based on the internal temperature detected by the temperature sensor 12 and a color misregistration transformation stored in the memory 202, and also calculates an adjustment value for image formation timing. The memory 202 stores a color misregistration table that correlates the internal temperature with the amounts of the color misregistrations of YMC and the information about the color misregistration transformation that converts the color misregistration calculated based on the color misregistration table concerned.

An image formation timing control unit 205 generates a principal scanning synchronizing signal based on the signal outputted by the BD sensor (not shown), and controls a principal scanning writing start timing of each of the laser scanning units 3*a* through 3*d*. The image formation timing control unit 205 adjusts the laser exposure timing and the exposure speed of each of the laser scanning units 3*a* through 3*d* based on the adjustment value for the image formation timing calculated by the CPU 201, and executes the adjustment operation for the image formation position of each color.

FIG. 3A is a view showing an example of a color misregistration table stored in the memory 202 as initial data. FIG. 3B is a view showing an example of the color misregistration table in which color misregistration detected information is added to the initial data stored in the memory 202.

As shown in the illustrated examples, the color misregistration table stores the internal temperature T degrees centigrade and the corresponding amounts of the color misregistrations Δy of yellow (Y), Δm of magenta (M), and Δc of cyan (C) in the principal scanning direction with respect to black (Bk) as the standard color. For example, Δy is denoted by the following regression of the nth degree.

$$\Delta y=\alpha_0+\alpha_1*T+\alpha_2*T^2+\alpha_3*T^3+\ldots+\alpha_n*T^n \quad \text{(Equation 1)}$$

For example, the regression coefficients $\alpha_0$ through $\alpha_n$ can be calculated with the least squares method by substituting the value in the color misregistration table to the equation 1. The amount of the color misregistration is predicted based on the internal temperature by using such a regression (color misregistration transformation), and the image formation timing is adjusted (referred to as a "prediction adjustment").

In this embodiment, the initial data obtained in the design phase of the product is stored as the color misregistration table of a factory default. In the design phase of the product, the initial data is obtained by performing a continuous print operation while monitoring the internal temperature until the internal temperature is saturated, and by forming and reading the color registration patterns when the internal temperature reaches a predetermined value. Such measurements are performed for a plurality of products, and the initial data of an average color misregistration table is obtained by leveling the data.

As mentioned later, the color misregistration detected information that is acquired when a user uses the apparatus is added to the color misregistration table in addition to the initial data, and the regression is also updated accordingly. For example, the table shown in FIG. 3B contains the amounts of the color misregistrations of the respective colors at 27 degrees centigrade in addition to the initial data in the table shown in FIG. 3A. This enables the color misregistration prediction adjustment that reflects the characteristic of the correlation between the internal temperature and the amount of the color misregistration that differs from apparatus to apparatus.

Although this embodiment aims to adjust the color registration in the principal scanning direction, the present invention is not limited to this, and may adjust color registration or inclination in the auxiliary scanning direction or another color registration.

Next, procedures of the color registration adjustment operation in this embodiment will be described with reference to FIG. 4 and FIG. 5.

Figure 4:
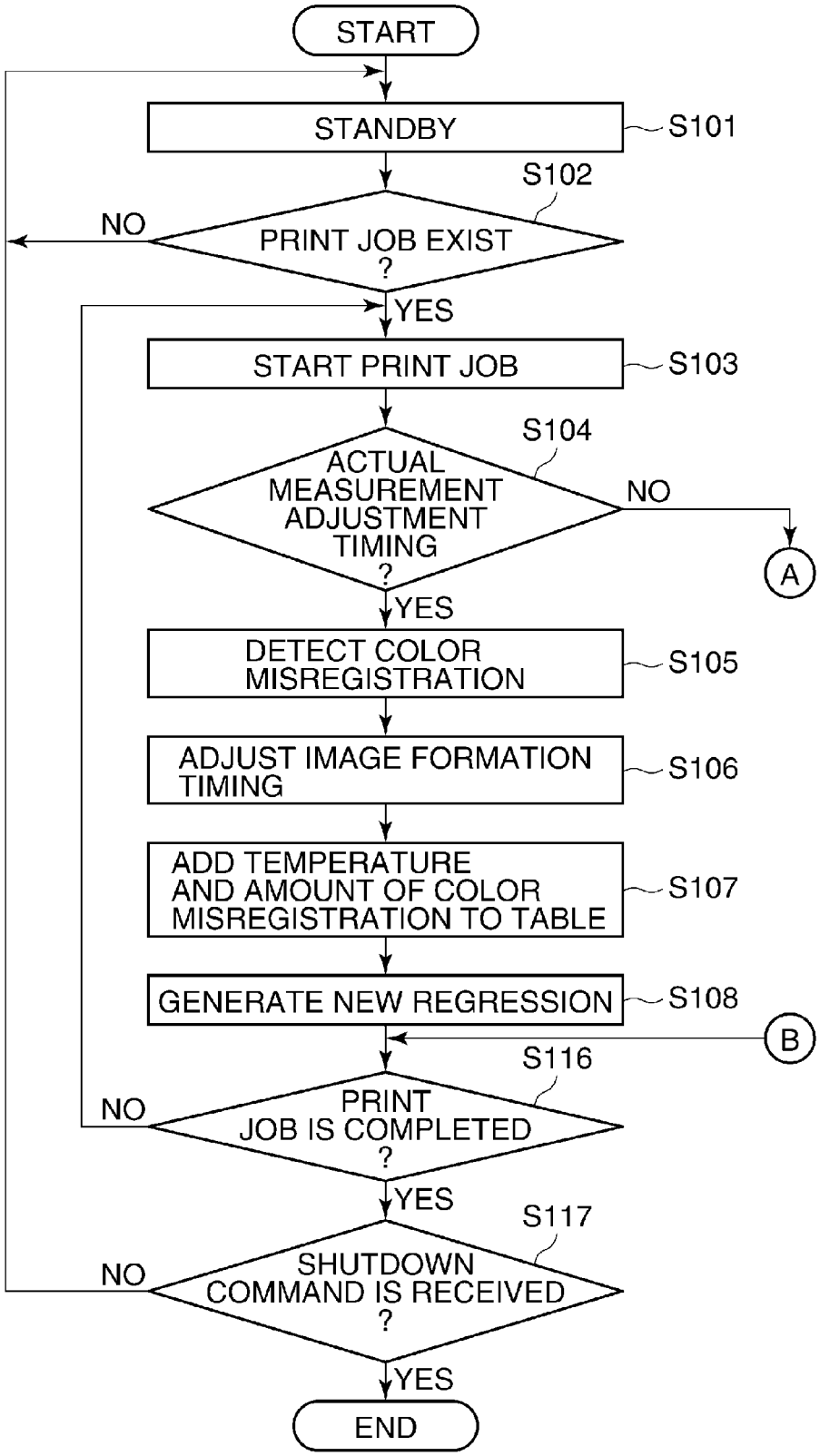
FIG. 4 is a flowchart showing a part of the color registration adjustment operation that is executed at the time of the image formation in the image forming apparatus in FIG. 1.
Figure 5:
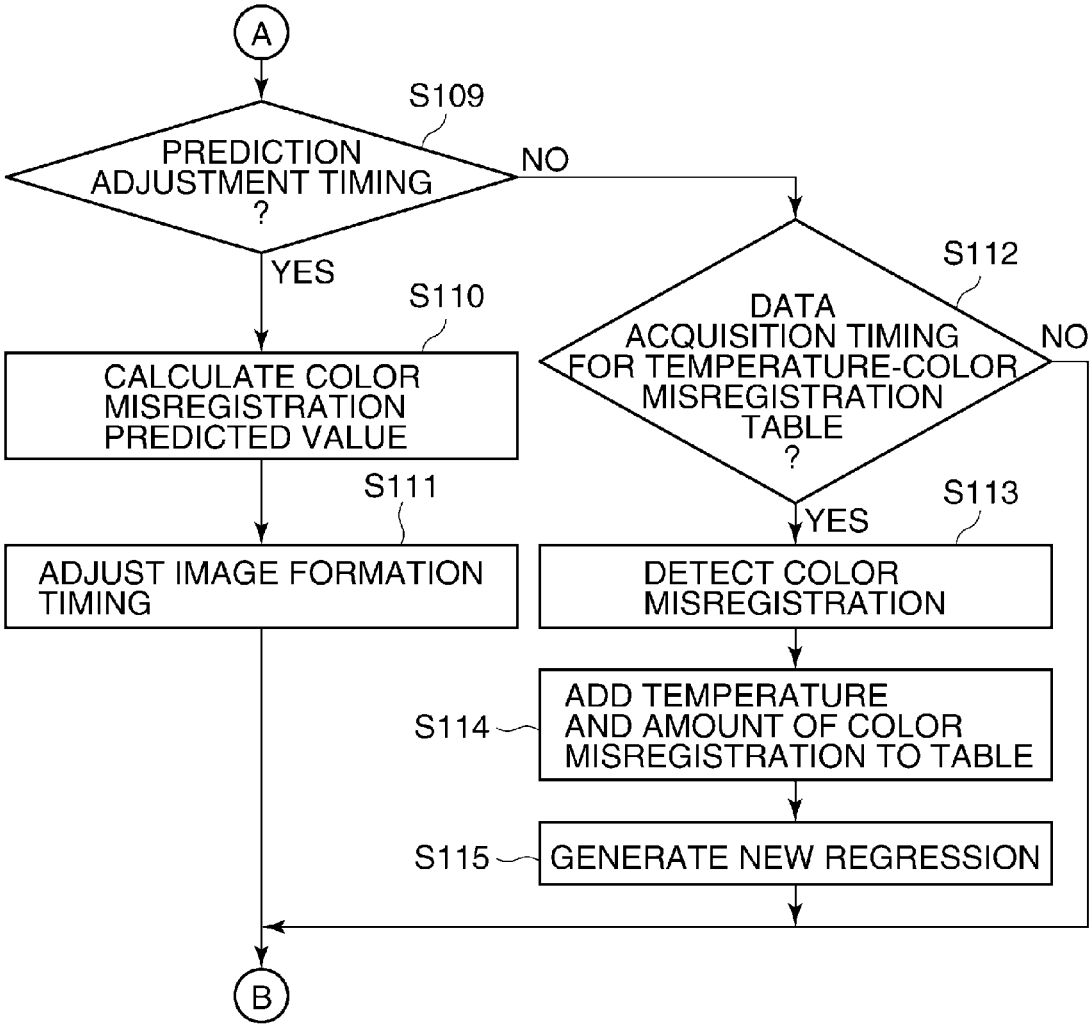
FIG. 5 is a flowchart showing the remainder of the color registration adjustment operation that is executed at the time of the image formation in the image forming apparatus in FIG. 1.

FIG. 4 and FIG. 5 show flowcharts of the color registration adjustment operation that is executed at the time of the image formation in the image forming apparatus 1. It should be noted that this process is achieved by executing a control program read from the memory 202 by the CPU 201 as long as there is no particular comment.

As shown in FIG. 4, the image forming apparatus 1 shifts to a standby state (step S101) after a power supply turns ON, and then shifts to a state for waiting for an input of a print job (step S102). When a print job is inputted (YES in the step S102), a print operation according to the print job starts (step S103).

Next, the CPU 201 determines whether execution timing of an adjustment operation based on an actual measurement (actual measurement adjustment timing) has come during the execution of the print operation (step S104). Here, the actual measurement adjustment timing comes when the number of printed sheets of the apparatus reaches a first reference value or a continuous printing time reaches a first reference period, and it can be set up arbitrarily beforehand.

When the CPU 201 determines that the actual measurement adjustment timing has come in the step S104, the detection of the color misregistration and the adjustment operation will be performed as mentioned below.

Figure 6:
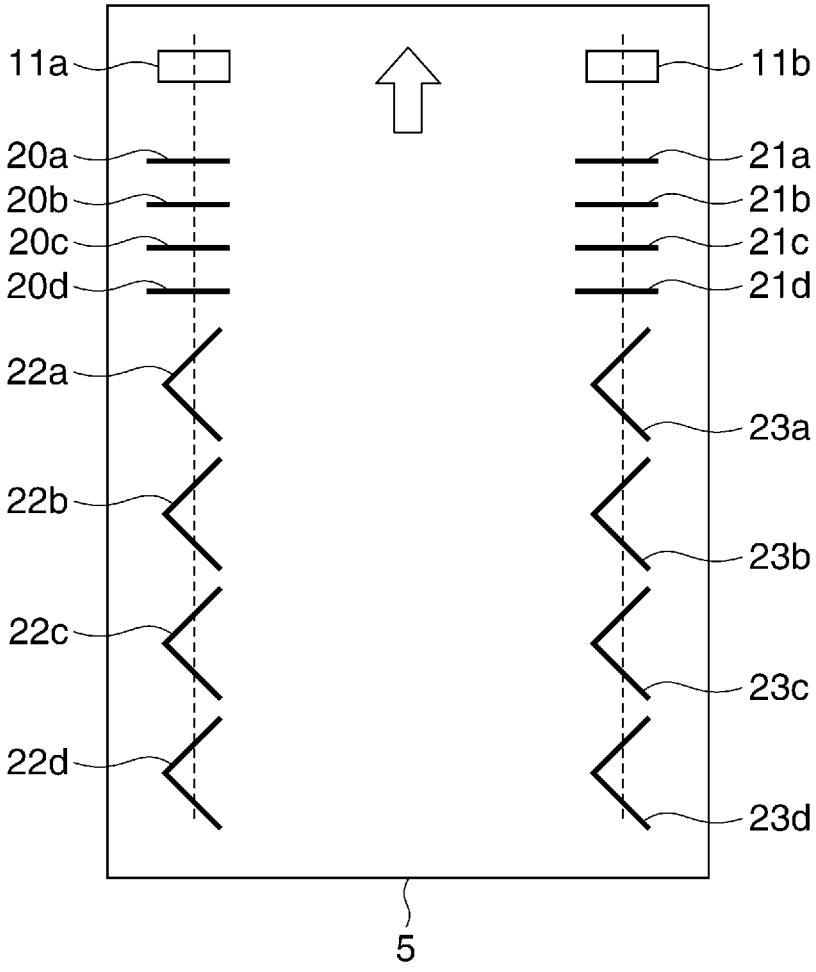
FIG. 6 is a view showing an example of color registration patterns formed on a transfer belt.

First, the CPU 201 forms predetermined color registration patterns on the transfer belt in step S105, and reads the color registration patterns by a pair of registration detection sensors 11 provided at both sides over the transfer belt. FIG. 6 is a view showing an example of the color registration patterns formed on the transfer belt.

In FIG. 6, the patterns 20*a* through 20*d*, 21*a* through 21*d* are used in order to detect the amount of the color misregistration in a sheet conveyance direction (an arrow in FIG. 6). The patterns 22*a* through 22*d*, 23*a* through 23*d* are used in order to detect the amount of the color misregistration in the principal scanning direction that intersects perpendicularly with the sheet conveyance direction. Usually, a plurality of sets of color registration patterns are formed at once in consideration of the periodic nonuniformity of the driving speed of the transfer belt 5. The amounts of the color misregistrations are calculated as differences between the predetermined standard color and the other colors by leveling the sampling results (the step S105 in FIG. 4). The amounts of the color registration adjustments for the respective colors with respect to the standard color are calculated for the respective items (the inclination and the writing start position in the auxiliary scanning direction, the writing start position in the principal scanning direction, the total magnification, etc.) based on the calculated amounts of the color misregistrations of the respective colors (the step S105 in FIG. 4).

Based on the calculated amounts of color registration adjustments, the CPU 201 calculates the adjustment amount of the image formation timing, and the image formation timing control unit 205 adjusts the image formation timing (step S106).

Next, the CPU 201 adds the amount of the color misregistration detected in the step S105 and the internal temperature to the color misregistration table (step S107), calculates a new regression based on the color misregistration table, and updates the regression (step S108).

A concrete example of the process in steps S107 and S108 will be described.

First, when the color misregistration table is in the state shown in FIG. 3A, the internal temperature when detecting the color misregistration in the step S105 shall be 27 degrees centigrade, and that the amount of the color misregistration detected by the registration detection sensors 11 shall be 22 μm. In this case, the data at 27 degrees centigrade is added to the color misregistration table as shown in FIG. 3B, and a new regression is calculated based on the color misregistration table in FIG. 3B. For example, when a quadratic regression about the color misregistration of yellow (Y) with respect to black (Bk) based on the color misregistration table shown in FIG. 3B, the Δy is expressed by the following regression.

$$\Delta y=-0.026*T^2+3.93*T-66.7 \quad \text{(Equation 2)}$$

Thus, the data inherent in the individual apparatus is accumulated to the color misregistration table in addition to the initial data using average values as the operating time by a user lapses. This reflects the characteristic inherent in the individual image forming apparatus to the color misregistration table and the regression.

When determining that the actual measurement adjustment timing has not come in the step S104 in FIG. 4, the CPU 201 proceeds with the process to step S109 in FIG. 5, and determines whether the prediction adjustment timing has come. When determining that the prediction adjustment timing has come, the CPU 201 calculates the predicted value of the amount of the color misregistration based on the detected value of the internal temperature and the regression (step S110), and the image formation timing control unit 205 adjusts the image formation timing (step S111). In the step S110, the CPU 201 functions as the color misregistration prediction unit. The prediction adjustment timing comes when the number of printed sheets of the apparatus reaches a second reference value, when a continuous printing time reaches a second reference period, or when the variation of the internal temperature reaches a predetermined value, and it can be set up arbitrarily beforehand. It should be noted that the frequency of the prediction adjustment timing is preferably higher than that of the actual measurement adjustment timing accompanied by formation of the above-mentioned color registration patterns. That is, the first reference value is larger than the second reference value, and the first reference period is set to be longer than the second reference period. Accordingly, the color misregistration that occurs after the color registration adjustment accompanied by formation of the color registration patterns by the next color registration adjustment can be reduced by the prediction adjustment.

The adjustment operation to the color misregistration of yellow (Y) on the basis of black (Bk) will be described as an example when the prediction adjustment timing has come.

In the step S110, when the detected internal temperature is 36.5 degrees centigrade and the regression of the temperature-color misregistration (Δy) at that time is expressed by the above equation 2, the predicted value of the amount of the color misregistration of yellow (Y) is calculated as Δy=42.2 μm using the regression and the detected internal temperature.

Here, the adjustment operation to the image formation timing based on the calculated predicted value of the amount of the color misregistration will be described using a timing chart in FIG. 7.

Figure 7:
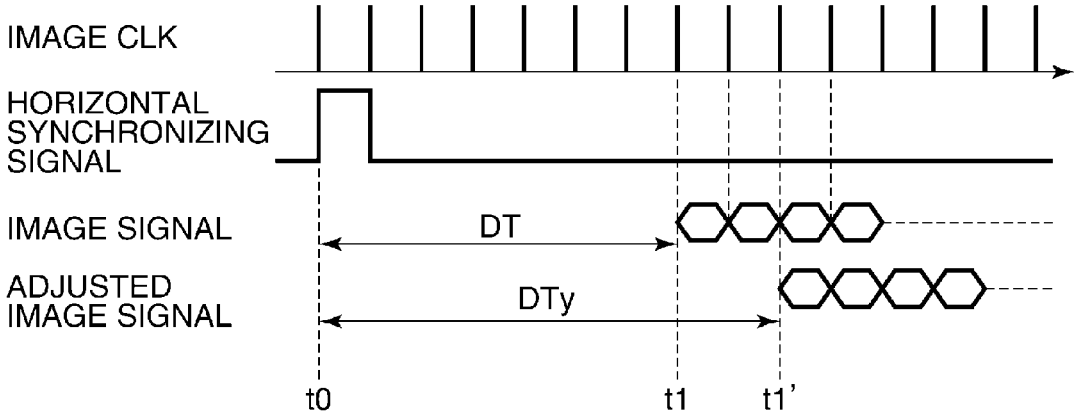
FIG. 7 is a timing chart showing an image CLK signal, a horizontal synchronizing signal, and a writing start timing of an image signal in the image forming apparatus in FIG. 1.

FIG. 7 is the timing chart showing an image CLK signal, the horizontal synchronizing signal mentioned above, and the writing start timing of the image signal.

The horizontal synchronizing signal is generated from the above-mentioned BD signal (t0 in FIG. 7), and the image signal is generated (t1 in FIG. 7) after predetermined delay time DT that is equivalent to a space in the principal scanning direction from the horizontal synchronizing signal (t0). In the initial state without the color registration adjustment, the image formation for each color starts at t1. In the state with the color registration adjustment, the start timing of the image formation is adjusted by changing the delay time DT for every color. In this embodiment, since the amount of the color misregistration of Y on the basis of Bk in the principal scanning direction is 42.2 μm (it is equivalent to 44 ns of laser scan time in the case of 1200 dpi, for example), the start timing of the image formation of yellow (Y) is adjusted by changing the delay time of yellow (Y) to DTy that is defined in the following equation.

DTy=DT+44 [ns] Thus, the color misregistration of a color other than the standard color (Bk in this example) in the principal scanning direction is corrected by changing the delay time DT according to the detection result of the amount of the color misregistration.

When determining that the prediction adjustment timing has not come in the step S109 in FIG. 5, the CPU 201 determines whether data acquisition timing for the color misregistration table has come (step S112). When it is determined that the data acquisition timing for the color misregistration table has come, the predetermined color registration patterns are formed on the transfer belt, the formed color registration patterns are detected by the registration detection sensors 11, and the amounts of the color misregistrations are calculated like in the step S105 (step S113).

Next, the CPU 201 adds the calculated amounts of the color misregistrations and the internal temperature to the color misregistration table (step S114), generates a new regression, and updates the regression (step S115) like in the steps S107 and S108.

Here, the data acquisition timing for the color misregistration table comes when the internal temperature reaches one of predetermined values. The predetermined values of the internal temperature are set every 5 degrees centigrade between 10 degrees centigrade and 45 degrees centigrade, and they cover the internal temperatures assumed as an operating environment.

Accordingly, since the data acquisition timing for the color misregistration table is set on the basis of an internal temperature independently of the color registration adjustment timing mentioned above, the internal temperature of the data acquisition timing for the color misregistration table does not incline toward the high temperatures, which enables to generate more accurate temperature-color misregistration regression.

The formation of the color registration patterns in the step S113 in FIG. 5 aims only to add the data to the color misregistration table, the adjustment operation is not performed based on the data detected in the step S113 only. Therefore, it is unnecessary to form a plurality of sets of color registration patterns at once in consideration of the driving speed nonuniformity like the time of the above-mentioned color registration adjustment. One set of pattern may be formed for each color, or a pattern of the standard color and a pattern of another color may be formed at once. This reduces the down time accompanying the color registration pattern formation for data acquisition.

In the step S116 in FIG. 4, the CPU 201 determines whether the print job is completed. When the print job is not completed, the CPU 201 returns the process to the step S103 and restarts the print operation according to the print job. On the other hand, when determining that the print job is completed, the CPU 201 determines whether a shutdown command is received (step S117). When there is no shutdown command, the CPU 201 returns the process to the standby state (the step S101). When there is a shutdown command, the CPU 201 executes a power shutdown process of the apparatus, and finishes this process.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-140672, filed on Jun. 24, 2011, which is hereby incorporated by reference herein in its entirety.

What is claimed is:

1. An image forming apparatus comprising:

a plurality of image forming units;

an image bearing member configured to bear images formed by said image forming units;

a table indicative of a correspondence relationship between temperature and an amount of a color misregistration;

a pattern detection unit configured to detect color registration patterns on said image bearing member;

a calculation unit configured to calculate the amount of the color misregistration based on the detection result of the color registration patterns by said pattern detection unit;

a temperature detection unit configured to detect temperature;

a color registration adjustment unit configured to have a first mode in which color registration adjustment is performed based on the amount of the color misregistration calculated by said calculation unit, and a second mode in which the amount of the color misregistration is predicted based on the temperature detected by said temperature detection unit using said table and color registration adjustment is performed based on the predicted amount of the color misregistration; and an updating unit configured to make said image forming units form the color registration patterns when the temperature detected by said temperature detection unit reaches a predetermined temperature, and to update said table based on the amount of the color misregistration calculated by said calculation unit based on the detection result of the color registration patterns by said pattern detection unit.

2. The image forming apparatus according to claim 1, wherein said color registration adjustment unit performs the color registration adjustment in the first mode when actual measurement adjustment timing has come, and performs the color registration adjustment in the second mode when prediction adjustment timing of which frequency is higher than the actual measurement adjustment timing has come, and wherein said updating unit updates said table based on the amount of the color misregistration calculated by said calculation unit and the temperature detected by said temperature detection unit when the actual measurement adjustment timing has come in addition to the time when the temperature reaches the predetermined temperature.

3. The image forming apparatus according to claim 2, wherein the actual measurement adjustment timing comes when the number of printed sheets of the image forming apparatus reaches a first reference value, and the prediction adjustment timing comes when the number of printed sheets reaches a second reference value that is smaller than the first reference value.

4. The image forming apparatus according to claim 2, wherein the actual measurement adjustment timing comes when a continuous printing time reaches a first reference period, and the prediction adjustment timing comes when the continuous printing time reaches a second reference period that is shorter than the first reference period.

5. A control method for an image forming apparatus that is provided with a plurality of image forming units, an image bearing member for bearing images formed by the image forming units, and a table indicative of a correspondence relationship between temperature and an amount of a color misregistration, the control method comprising:

a pattern detection step of detecting color registration patterns on the image bearing member;

a calculation step of calculating the amount of the color misregistration based on the detection result of the color registration patterns in said pattern detection step;

a temperature detection step of detecting temperature;

a first color registration adjustment step of performing a color registration adjustment based on the amount of the color misregistration calculated in said calculation step;

a second color registration adjustment step of predicting an amount of the color misregistration based on the temperature detected in said temperature detection step using the table, and of performing a color registration adjustment based on the predicted amount of the color misregistration; and an updating step of making the image forming units form the color registration patterns when the temperature detected in said temperature detection step reaches a predetermined temperature, and of updating the table based on the amount of the color misregistration calculated in said calculation step based on the detection result of the color registration patterns in said pattern detection step.

6. A non-transitory computer-readable storage medium storing a program for causing a computer to execute a method for controlling an image forming apparatus that is provided with a plurality of image forming units, an image bearing member for bearing images formed by the plurality of image forming units, and a table indicative of a correspondence relationship between temperature and an amount of a color misregistration, the control method comprising:

a pattern detection step of detecting color registration patterns on the image bearing member;

a calculation step of calculating the amount of the color misregistration based on the detection result of the color registration patterns in said pattern detection step;

a temperature detection step of detecting temperature;

a first color registration adjustment step of performing a color registration adjustment based on the amount of the color misregistration calculated in said calculation step;

a second color registration adjustment step of predicting an amount of the color misregistration based on the temperature detected in said temperature detection step using the table, and of performing a color registration adjustment based on the predicted amount of the color misregistration; and an updating step of making the image forming units form the color registration patterns when the temperature detected in said temperature detection step reaches a predetermined temperature, and of updating the table based on the amount of the color misregistration calculated in said calculation step based on the detection result of the color registration patterns in said pattern detection step.

* * * * *